US005432990A

United States Patent [19]

Seneff

[11] Patent Number: 5,432,990

[45] Date of Patent: Jul. 18, 1995

[54] APPARATUS FOR APPLYING FRAMES TO FABRIC

[76] Inventor: Robert W. Seneff, W224 N2829 Stonewood Ct., Waukesha, Wis. 53186

[21] Appl. No.: 53,070

[22] Filed: Apr. 26, 1993

[51] Int. Cl.[6] ..... B23P 19/02; B23Q 3/10

[52] U.S. Cl. ..... 29/251; 29/281.4; 108/102; 108/137; 248/172; 248/176; 248/429; 269/47; 269/71; 269/296

[58] Field of Search ..... 29/251, 281.3, 281.4, 29/283; 269/47, 49, 50, 55, 164, 165, 78, 248, 296, 310, 71; 108/59, 61, 64, 65, 83, 90, 102, 143; 38/137, 103, 110, 112, 135, 136, 138; 248/172, 176, 424, 429

[56] References Cited

U.S. PATENT DOCUMENTS

| | | | |
|---|---|---|---|
| 662,982 | 12/1900 | Stevens . | |
| 1,294,713 | 2/1919 | Runnette . | |
| 2,188,433 | 1/1940 | Friese | 269/296 X |
| 2,190,582 | 2/1940 | Wolf | 88/56 |
| 2,362,185 | 11/1944 | Brammer | 29/235 |
| 2,533,870 | 12/1950 | Bayer | 81/7 |
| 2,753,897 | 7/1956 | Conrad | 140/109 |
| 3,099,875 | 8/1963 | Lelis | 29/227 |
| 3,584,362 | 6/1971 | Hazel et al. | 29/281.4 X |
| 3,608,179 | 9/1971 | Jeffree et al. | 29/446 |
| 3,705,454 | 12/1972 | Zuhlke | 29/208 |
| 3,871,055 | 3/1975 | Dail | 29/267 |
| 3,874,058 | 4/1975 | Jesevich et al. | 29/208 D |
| 4,538,335 | 9/1985 | Moore, III | 29/251 |
| 4,561,177 | 12/1985 | Rancer | 29/721 |
| 4,606,280 | 8/1986 | Poulton et al. | 108/65 X |
| 4,620,352 | 11/1986 | Sulej | 29/251 |
| 4,767,111 | 8/1988 | Guenther | 269/303 |
| 4,805,297 | 2/1989 | Seneff | 29/721 |
| 4,875,268 | 10/1989 | Szarka | 269/47 X |
| 4,910,894 | 3/1990 | Vartan | 38/135 X |
| 4,955,765 | 9/1990 | Laird | 108/90 X |
| 5,016,367 | 5/1991 | Breen et al. | 38/103 X |

FOREIGN PATENT DOCUMENTS

| | | | |
|---|---|---|---|
| 7805887 | 2/1979 | Netherlands | 248/176 |
| 452827 | 5/1968 | Switzerland | 108/90 |
| 917378 | 3/1982 | U.S.S.R. | 29/281.4 |

OTHER PUBLICATIONS

IBM Technical Disclosure Bulletin, vol. 26, No. 7A, Dec. 1983 Grospin, Hassebrook and Shlatz.

"MacFrame Puts Tension in its Place . . . " flyer of Macpherson, Inc. P.O. Box 1889, Greensboro, N.C. 27402.

Impressions, vol. 10, No. 9, Jan. 1987, p. 168.

*Primary Examiner*—Joseph M. Gorski

*Attorney, Agent, or Firm*—Quarles & Brady

[57] ABSTRACT

A machine for applying frames to fabric in preparation for embroidering the fabric has a pair of table halves which are laterally adjustable in position to vary the spacing between them and to vary their positions relative to a frame holder. A neck piece at the front edge of each table half is also laterally adjustable relative to the table halves so as to more closely approximate the shape of a garment when it is slipped over the table. An apparatus for applying frames having an image projector and a two-bar linkage for advancing the upper frame half toward the lower frame half is also disclosed.

3 Claims, 4 Drawing Sheets

FIG. 7
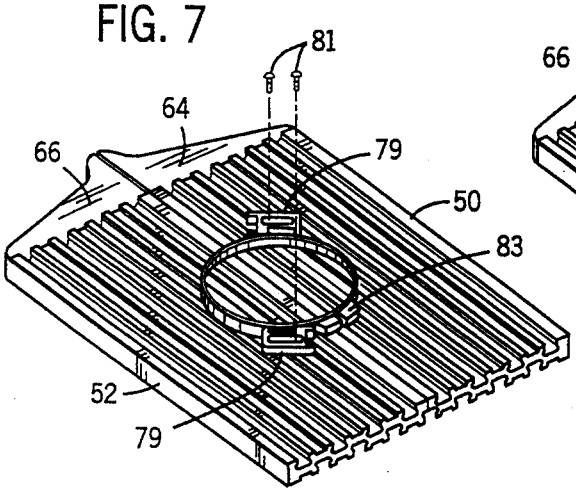
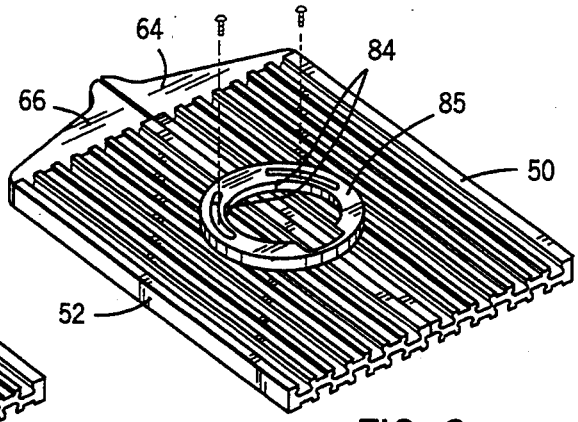
FIG. 8
FIG. 3
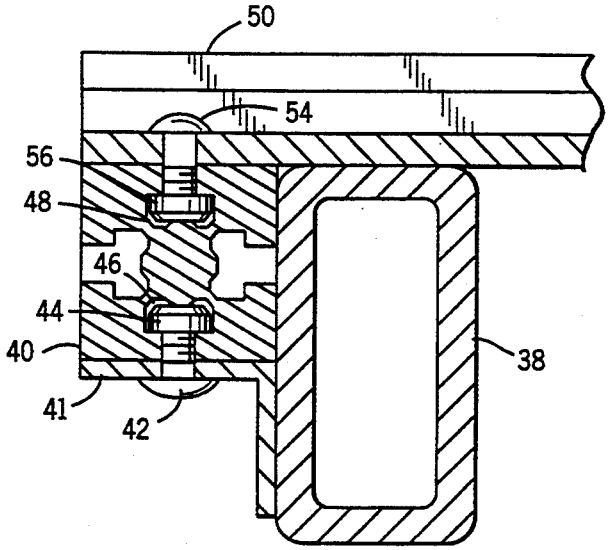
FIG. 6
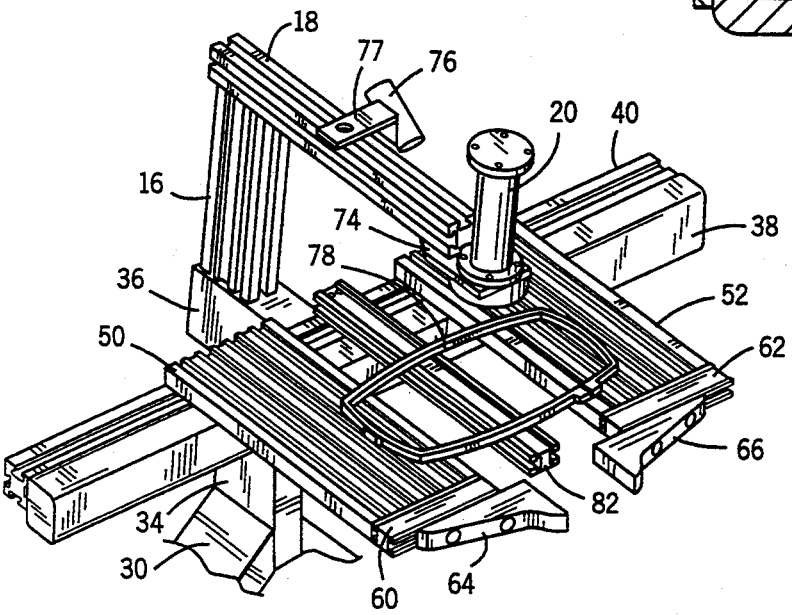

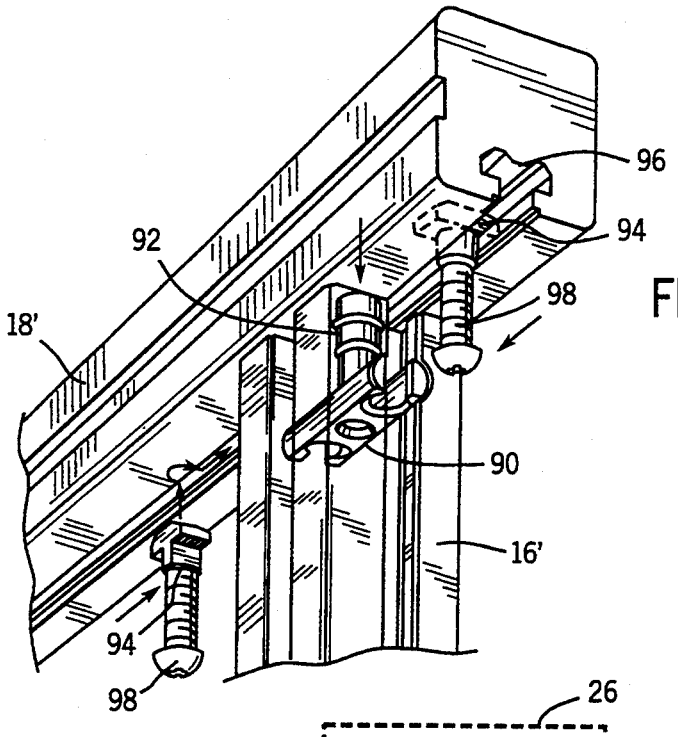
FIG. 10
FIG. 12
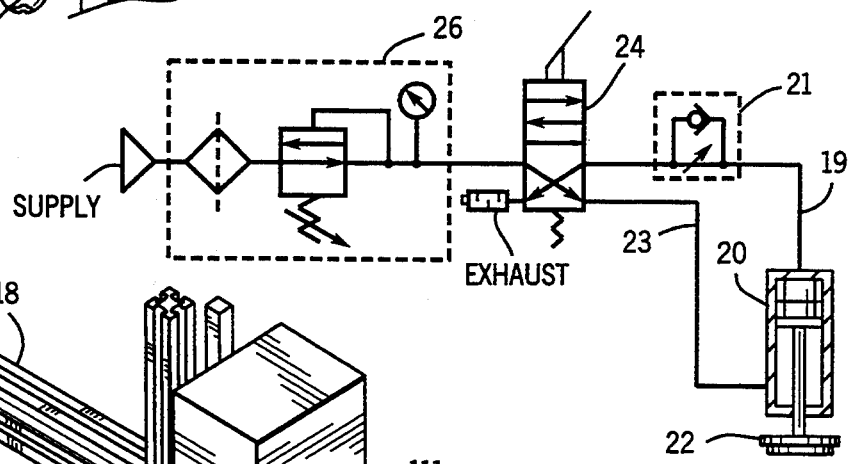
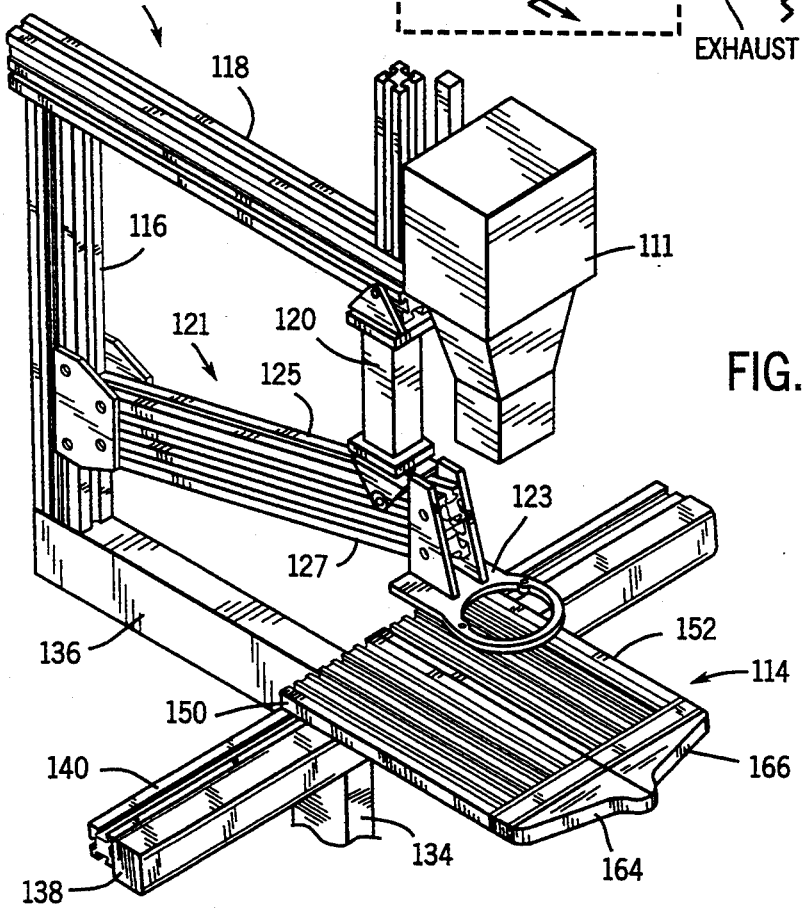
FIG. 11

APPARATUS FOR APPLYING FRAMES TO FABRIC

BACKGROUND OF THE INVENTION

1. Field of the Invention

The invention relates to an improved machine for applying frames to fabric in preparation for embroidering or monogramming the fabric.

2. Discussion of the Prior Art

In preparation for embroidering a fabric article, such as a golf shirt, sweat shirt, T-shirt, leather jacket, etc., it is usually necessary to hold and tension the area to be embroidered within a frame which has an inner half and an outer half. The frame must be aligned with the area of fabric to be embroidered, which has posed a problem in the prior art.

U.S. Pat. No. 4,805,297 of the present applicant discloses an apparatus for applying frames to fabric which solves many of the problems in the prior art by using a laser beam to align a mark on an article of clothing to be embroidered with a frame which is applied by the machine. While this resulted in better and more uniform placement of the fabric within the frames, it still required manually positioning a mark on the fabric under the laser beam.

For mass production of embroidered articles of clothing and also a great range of different types of clothing and positions of the areas of embroidering for the same clothing type, it is desirable to have a machine which can be set-up to quickly align the embroidered area on the machine with a minimum of manual alignment by the machine operator. It is also desirable to be able to quickly align the area to be embroidered on the machine while also insuring the accuracy of the alignment.

SUMMARY OF THE INVENTION

The invention provides an apparatus for applying frames to fabric having a table which is laterally slidable (side to side) relative to a frame holder supported above the table so that the lateral position of the frame holder relative to the table can be adjusted. By moving the table relative to the frame holder, any lateral position of a garment, e.g., left, right or center, can be positioned under the frame holder in preparation for the frame holder to apply a frame to the selected area of the garment. Since the fit of the garment on the table helps position the garment relative to the frame holder, accurate alignment of the area of the garment to be framed and the frame holder is assured.

In a preferred form, a stand for the apparatus includes a lateral slideway for mounting the table so that the table is slidable relative to the stand, as opposed to the frame holder being slidable relative to the stand. Sliding the table rather than the frame holder facilitates relative position changes between the table and frame holder, since the frame holder has mechanism or pneumatic or hydraulic lines associated with it to cause it to move toward the table.

It is also preferred that the table include a pair of table halves and the lateral spacing between the table halves be adjustable. By adjusting the lateral spacing between the table halves, the table can be adjusted to provide a snug or near snug fit between it and a garment slipped over it, so as to facilitate accurate lateral positioning of the area to be framed with the frame holder.

In a preferred form, each table half has a neck piece positioned at its front edge and extending forwardly therefrom. Each neck piece is mounted to its associated table half so as to be laterally adjustable in position relative thereto. Thereby, the neck pieces can be moved together or apart so as to more closely approximate the shape of a garment which is slipped over the table. Preferably, each said neck piece is contoured so that when it is positioned adjacent to the other neck piece the two neck pieces define at their forward edges a shape approximating the neck and shoulder areas of a garment.

In another preferred aspect, the apparatus also has a laser with a beam directed at the table for aligning the fabric article with the frame holder. This provides confirmation of the positioning of the area to be embroidered.

DESCRIPTION OF THE DRAWINGS

FIG. 3 is a sectional view showing the connection of a slideway to a table of the machine shown in FIGS. 1 and 2;

FIG. 6 is a partial perspective view of a machine of the invention set-up to apply a frame to a center area of a large garment;

FIG. 7 is a perspective view illustrating one way of positioning a frame on the table of the apparatus of FIGS. 1 and 2;

FIGS. 8 and 9 are similar to FIG. 7 but illustrate other frame holders for positioning a frame on the table;

FIG. 10 is a schematic perspective view illustrating fittings for making a sliding connection between an arm and a column of the apparatus;

FIG. 11 is a partial perspective view of an alternate embodiment of the invention; and FIG. 12 is a schematic view of an air circuit for the apparatus.

DETAILED DESCRIPTION OF THE PREFERRED EMBODIMENTS

Figure 1:
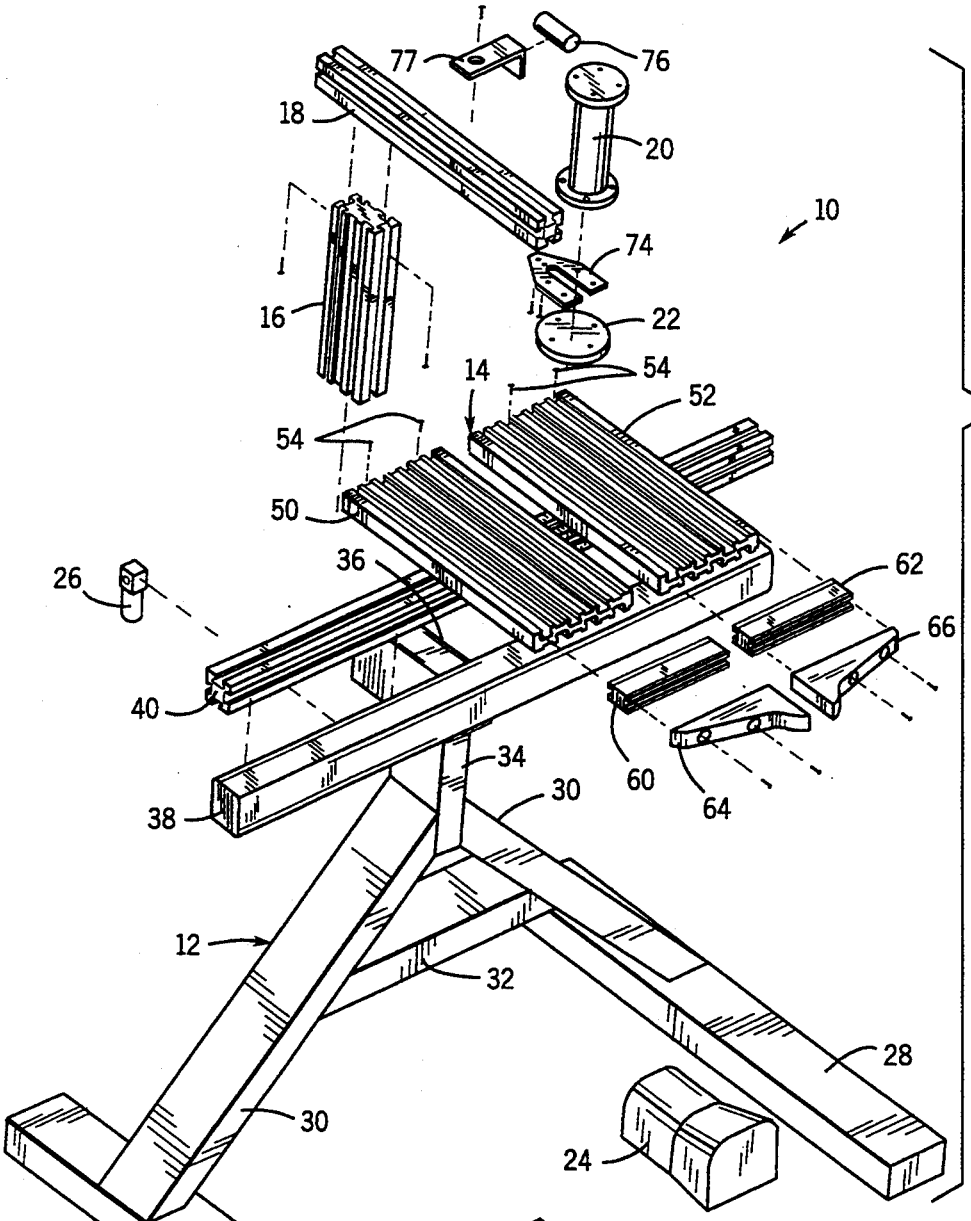
FIG. 1 is an exploded perspective view of an improved apparatus of the present invention for applying frames to fabric (air lines are not shown for clarity)

FIG. 1 illustrates an apparatus 10 of the present invention including a stand 12 and a table 14. The apparatus 10 also includes a support column 16 extending above the table 14, an arm 18 and a pneumatic cylinder 20 having a pressure plate 22 fixed at the lower end of its piston for holding an inner frame half (not shown) to be applied to an outer frame half (not shown) supported on the table 20. In addition, the apparatus 10 includes an air circuit which includes a foot valve 24 and air regulator 26 for controlling the operation of the pneumatic cylinder 20. In the apparatus 10, the pressure plate frame holder 22 is preferably as described in U.S. Pat. No. 4,805,297 which issued Feb. 21, 1989 to the applicant hereof, the entire disclosure of which is hereby incorporated by reference.

The stand 12 has feet 28 welded to the lower ends of legs 30, a reinforcement 32 welded at its ends to the legs 30, and extension 34 welded to the tops of the legs 30 and having its upper end welded to a crosspiece 36. The forward end of the crosspiece 36 is welded to a main mount 38 which runs laterally.

Referring particularly to FIG. 3, a slideway 40 which runs laterally is bolted to angle iron supports 41 which are welded at spaced locations to the main mount 38 so as to support the slideway 40. The slideway 40 has its forward face abutting the rearward face of the mount 38 and its top surface in generally the same plane as the top surface of the mount 38. A bolt 42 extends through each support 41 and is threaded into a corresponding nut 44 which is received in bottom-opening T-shaped slot 46 of the slideway 40, although the slideway 40 may be fixed to the mount 38 by any suitable means including but not limited to that disclosed.

The slideway 40 also has a top opening T-shaped slot 48 which runs laterally. The table 14 includes two table halves 50 and 52 which are secured to the slideway 40 so as to be laterally slidable relative thereto. This is accomplished using two bolts 54 which extend through the rear of each table half 50 and 52 and into the T-shaped slot 48. The bolts 54 are threaded into nuts 56 (FIG. 3) which bear against the underside of the flanges which define the T-shaped slot 48. When the bolts 54 are tight, the table halves 50 and 52 are secured to the slideway 40 but when the bolts 54 are loosened, the table halves 50 and 52 may be slid laterally relative to the slideway 40 to adjust their lateral position relative to the pneumatic cylinder 20 and pressure plate 22 and relative to each other.

It is also noted that with this arrangement the table halves 50 and 52 rest on top of the slideway 40 as well as on top of the mount 38. The table halves 50 and 52 extend forwardly from the mount 38 so as to be cantilevered therefrom, but the support afforded by the slideway 40 and the mount 38 is sufficient to withstand all forces normally encountered in operation when the pressure plate 22 presses an inner frame half into an outer frame half supported on the table 14, with the fabric between the two frame halves.

The front edge of each table half 50 and 52 fixedly mounts an edge extension 60 and 62, respectively, by any suitable means. The front edge of each extension 60 and 62 defines a forwardly opening T-shaped slot and neck pieces 64 and 66 are secured to the front edges of the edge extensions 60 and 62 in the same manner that the table halves 50 and 52 are secured to the slideway 40, so that the neck pieces 64 and 66 are slidable laterally relative to the edge extensions 60 and 62.

The column 16 is fixed to the rear of the crosspiece 36 and extends upwardly therefrom above the level of the table 14. The arm 18 is secured to the upper end of the column 16 so as to be slidable fore and aft relative thereto, preferably using a fitting and fasteners as illustrated in FIG. 10 which are commercially available from Bosch Automation Products of Buchanan, Mich. In FIG. 10, an alternate column 16' is shown which has a generally square (as opposed to rectangular as shown in FIG. 1) cross-section. Also, in FIG. 10, an alternate arm 18' is illustrated which has a fore and aft running T-shaped slot only in its bottom surface. In the connection between the column 16 or 16' and the arm 18 or 18', a fitting 90 having slotted ends is inserted into a fore and aft running bore of the column 16 or 16', and a plug 92 is inserted into an axial bore of the column 16 or 16' and into a central bore of the fitting 90 so as to hold the fitting 90 in the fore and aft bore of the column and maintain its orientation therein.

Serrated nuts 94 (nuts 44 and 56 are preferably similar to nuts 94) are inserted in bottom-opening T-shaped slot 96 of the arm 18 or 18' using the motion illustrated by the arrows in FIG. 10 and are captured in the T-shaped slot 96, bearing against the upper side of the flanges which define the T-shaped slot. Screws 98 are threaded into the nuts 94 and have their heads supported by the slotted ends of the fitting 90. When tight, the screws 98 secure the arm 18 or 18' to the column 16 or 16', but when loose allow the arm 18 or 18' to be longitudinally adjusted fore or aft so as to set up the apparatus 10 to apply a frame at a particular longitudinal location. While this is the preferred connection, it is noted that other connections of the arm to the column could be employed, for example such as the sliding connection described in U.S. Pat. No. 4,805,297, referred to above, another sliding connection, or a fixed connection.

It is noted that the column 16 or 16' can be secured to the crosspiece 36 using any suitable connection, but that one connection found suitable employs a fitting 90 and plug 92 as illustrated in FIG. 10 but at the lower end of the column. In such a connection, screws are captured by the slotted ends of the fitting 90 and extend down through the crosspiece 36, with nuts at the lower ends of the screws bearing against the lower surface of the crosspiece 36 to secure the column to the crosspiece.

Near the forward end of the arm 18, a plate 74 for mounting the pneumatic cylinder 20 is fixedly secured to the arm 18 using any suitable fastening means. In addition, the arm 18 mounts a laser 76 on a mounting plate 77 which is fixed to the arm 18. The laser 76 emits a beam that is directed toward a target on the table 14 that represents the position on table 14 where the center of pressure plate 22 will come down when the pneumatic cylinder 20 is actuated. In the present invention, the spot of laser light emitted by the laser 76 is useful to confirm the lateral and longitudinal alignment of the area to be embroidered, although the lateral and longitudinal alignment is primarily accomplished by adjusting the longitudinal position of the arm 18 or 18' as discussed above and by adjusting the position and spacing of the table halves 50 and 52 as hereinafter described.

Preferably, the slideway 40, table halves 50 and 52, edge extensions 60 and 62, column 16 (or 16') and arm 18 (or 18') are preformed aluminum extrusions having standard profiles which are commercially available from Bosch Automation Products of Buchanan, Mich. Typically, the slideway 40 is an extrusion having dimensions of 45 millimeters by 45 millimeters by 1066 millimeters, each table half is an extrusion of dimensions 22.5 millimeters thick by 180 millimeters wide, each edge extension 60 and 62 is an extrusion of dimensions 22.5 millimeters thick by 45 millimeters deep, the column 16 is an extrusion of dimensions 45 millimeters wide by 90 millimeters deep, and the arm 18 is an extrusion of dimensions 45 millimeters wide by 45 millimeters high. In addition, the fittings and fasteners for making the connections between the slideway 40, mount 38 and table halves 50 and 52, between the neck pieces 64 and 66, edge extensions 60 and 62 and table halves 50 and 52, and between the column 16, arm 18, stand 12, and plates 74 and 77, are also available from Bosch Automation Products. In the preferred embodiment, the neck pieces 64 and 66 are preferably formed of a plastic material such as a polycarbonate plastic.

Figure 2:
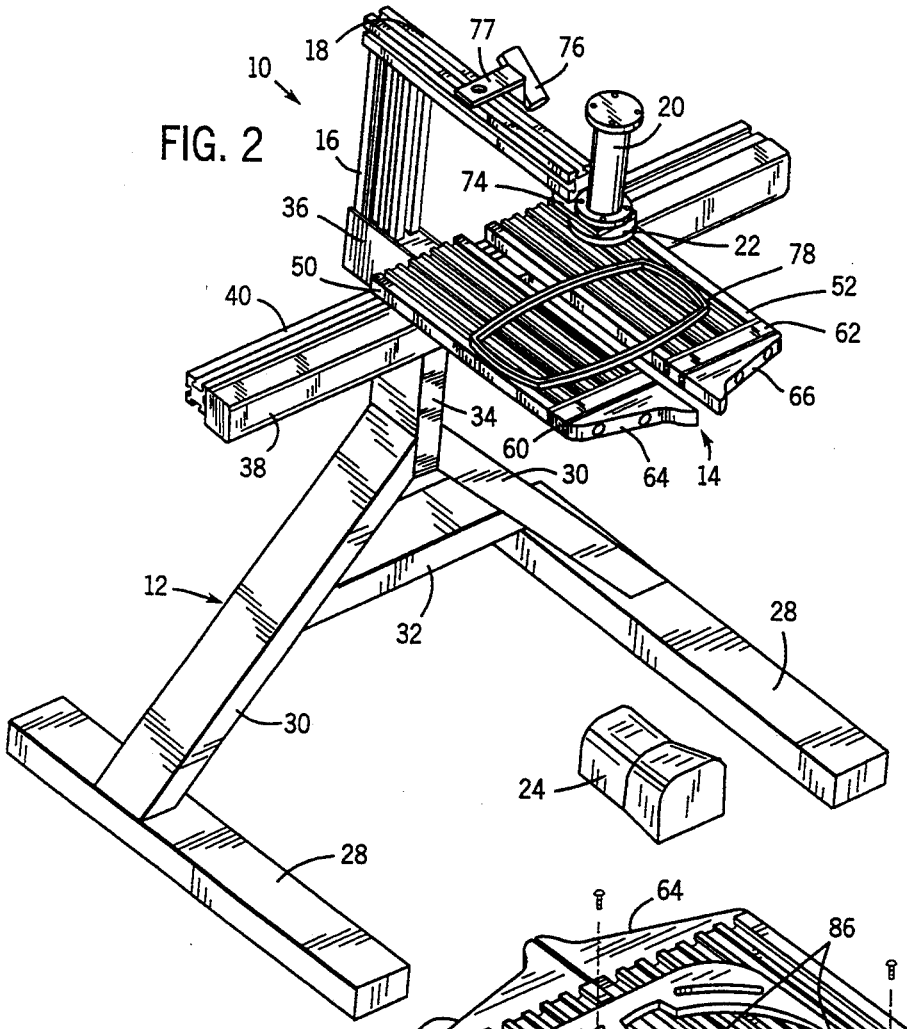
FIG. 2 is a perspective view of the apparatus of FIG. 1 shown assembled.

FIG. 2 illustrates how the table halves 50 and 52 may be positioned relative to one another and relative to the pressure plate 22 for applying a frame to a relatively small garment in which the embroidery is to be performed on the center front or center rear portion of the garment. If the garment is a shirt, the bottom portion of the shirt would be slipped over the neck pieces 64 and 66 as far as possible, until the neck pieces 64 and 66 contacted and generally conformed to the shoulder portions of the shirt, with the body portion of the shirt surrounding the table halves 50 and 52, and with the outer frame half 78 (shown supported by the table halves 50 and 52) beneath the front or rear (whichever is to be embroidered) center area of the shirt. An inner frame half (not shown) would be mounted to the pressure plate 22 using a suitable frame holder (not shown) which would have a shape to match the interior size and shape of the outer frame half 78 shown. Of course, the frame holder may also be mounted directly to the lower end of the piston of the air cylinder 20.

Preferably, the outer frame half is positioned relative to the table halves 50 and 52 using appropriate frame holders (see FIGS. 4–9) secured to the table 20 to position the outer frame half relative to the table halves 50 and 52 directly below and in alignment with the inner frame half held above the machine by the pressure plate 22 (if the frame halves are round) or other frame holder mounted to the pressure plate 22 or directly to the pneumatic cylinder 20. Then, when the pneumatic cylinder 20 was actuated, the inner frame half comes down in perfect alignment with the outer frame half with the garment between the two frame halves and the area of the garment to be embroidered within the inner frame half. It is also noted in this regard that the laser 76 is fixedly mounted to the arm 18, as is the pneumatic cylinder 20, so that even though the table halves 50 and 52 may be moved around and the fore and aft position of the arm 18 or 18' may be adjusted, the spot of laser light indicating the target on the table 20 will always indicate the axial center line of the pneumatic cylinder 20.

Figure 4:
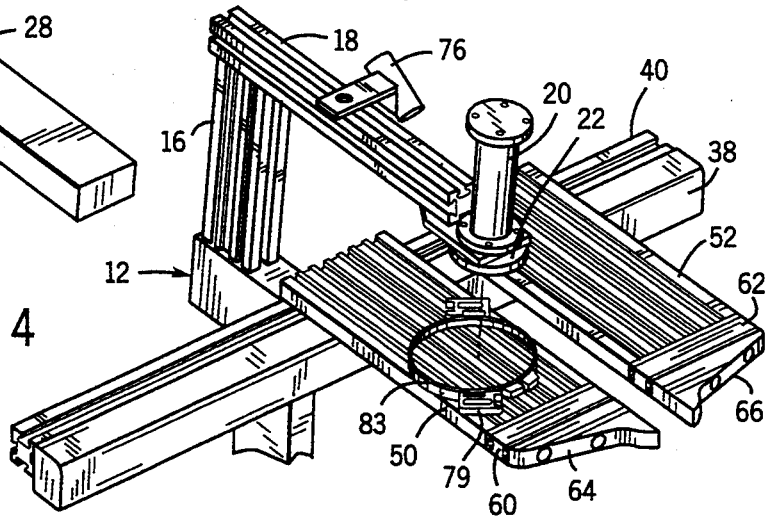
FIG. 4 is a partial perspective view showing the machine of FIGS. 1 and 2 set-up to apply a frame to the left pocket area of a small garment.

Referring to FIG. 4, the set-up for framing the left chest area of a small shirt type garment is illustrated. In this set-up, a circular outer frame is used and frame holders as described in U.S. Pat. No. 4,805,297 (See also FIG. 7) are used to position the frame halves relative to the table. Since the set-up is for a small garment, the table halves 50 and 52 are relatively close together and since it is a leftward application, table half 50 is positioned beneath the pressure plate 22. Preferably, the table halves 50 and 52 are spaced apart at a distance such that when the garment is slipped over the neck pieces 64 and 66, the garment is taut or near to being taut so as to accurately position the garment laterally and longitudinally relative to the outer frame half 80.

Figure 5:
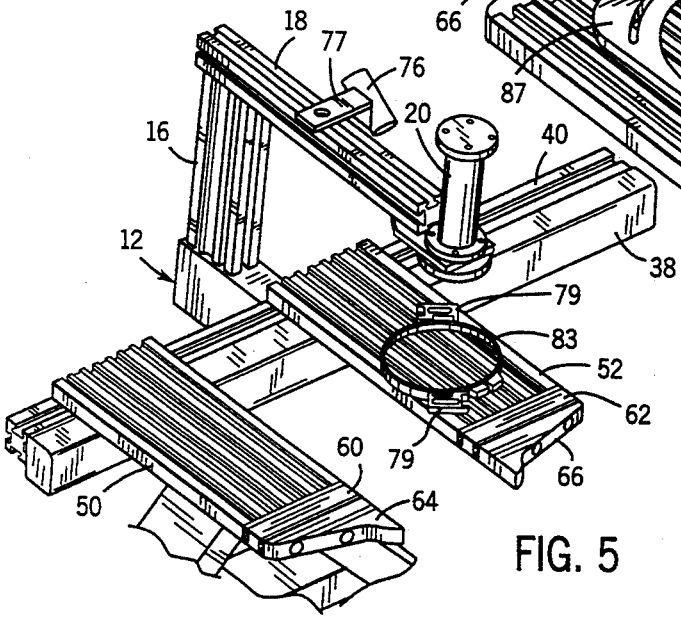
FIG. 5 is a partial perspective view illustrating the machines of FIGS. 1 and 2 set-up to apply a frame to the right pocket area of a large garment.

FIG. 5 is similar to FIG. 4, but illustrates a machine set-up for a right chest application with a relatively large garment. The table halves 50 and 52 are relatively far apart so as to be positioned for stretching the garment to be taut or nearly taut and the right table half 52 is positioned beneath the cylinder 20.

FIG. 6 illustrates a set-up for applying a frame to a large garment near the center of the garment. The table halves 50 and 52 are relatively far apart and for additional support an auxiliary table support 82 is secured to the slideway 40 in essentially the same manner as the table halves 50 and 52 and is positioned between the table halves 50 and 52 below the pressure plate 22. In addition, FIG. 6 illustrates sliding the neck pieces 64 and 66 toward one another so as to more closely approximate the neck and shoulder portions of a garment for more accurate positioning and more facile slipping of the garment over the table halves 50 and 52.

Figure 9:
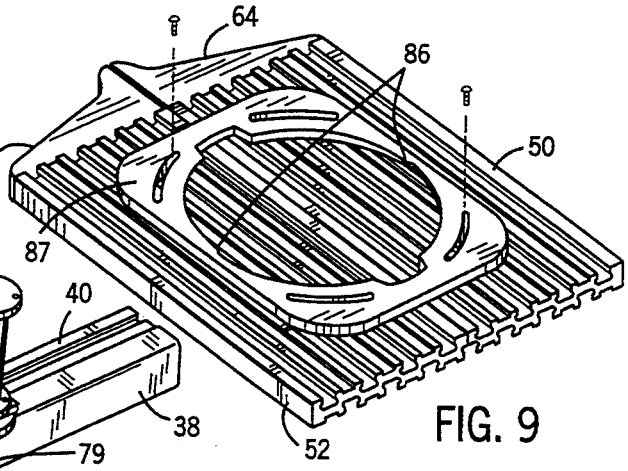

FIGS. 7–9 illustrate different holders for positioning an outer frame on the table halves 50 and 52. Also in FIGS. 7–9, an alternate arrangement of the neck pieces 64 and 66 is illustrated, with the neck pieces 64 and 66 secured directly to the respective table halves 50 and 52 and not laterally slidable relative thereto.

FIG. 7 illustrates the type of ear holders 79 used in FIG. 4 and also described in U.S. Pat. No. 4,805,297. As shown and described, the holders 79 are secured to the table 50 by screws 81 and have U-shaped slots to receive and position the opposed ears of an outer frame half 83.

FIG. 8 illustrates an outer frame holder 85 which encircles the entire outer frame (not shown) and FIG. 9 illustrates a large outer frame holder 87 which also encircles the entire outer frame (not shown). In the holders of FIGS. 8 and 9, the internal diameter of the holder is relieved at shoulders 84 and 86, respectively, to allow for expansion of the outer half when the inner half is pressed into it by the pneumatic cylinder 20.

FIG. 11 illustrates an alternate embodiment 110. In the embodiment 110, components corresponding to the components of the embodiment 10 are given the same reference numbers, plus 100.

In the embodiment 110, an image projector 111 is mounted to the arm 118 to project an image down onto the area of fabric to be embroidered. The image projected can be the same as an image which has been applied to the fabric area by a silk screening or other process, and the two images are aligned with one another for accurate positioning of the area within the frame. Since the cylinder 20 of the embodiment 10 would interfere with projecting such an image, it is necessary in the embodiment 110 to move the cylinder 120 back and provide a two-bar linkage 121 including a top bar 125 and a bottom bar 127, each of which is pivoted at its rear end to the column 116 and pivoted at its front end to frame holder 123. It is noted in this embodiment that the crosspiece 136 extends rearwardly a distance sufficient to accomodate the two-bar linkage 121. The top bar 125 is pivoted to the lower end of the piston of the cylinder 120 so that extension of the cylinder 120 urges the two-bar linkage 121 down while the linkage maintains the holder 123 in a generally horizontal orientation to hold the upper frame half in a plane which is parallel to the table 114. Preferably an inner frame half is held on the holder 123 by any suitable means, such as by spring loaded detents as described in U.S. Pat. No. 4,805,297, until it is pressed into an outer frame half supported on the table 114.

Any suitable means may be used to move the upper frame holder (22, 123 in the preferred embodiments) toward the table including a foot operated mechanism (not shown), an air cylinder and associated circuit as disclosed herein or any other suitable means, e.g., hydraulic, electric or manual. In the embodiment 118 having projector 111, any suitable means could be used to move the frame holder 123 toward the table 114 as long as the means is offset from the axial center line of the frame holder 123 so as not to obstruct the projected image. For example, a pair of air cylinders positioned 180° apart relative to the frame holder 123 could be used to advance the frame holder 123.

If pneumatic means are employed, a suitable circuit would be as disclosed in U.S. Pat. No. 4,805,297 if a spring return pneumatic cylinder is used, or as illustrated in FIG. 12 if a double acting cylinder 20 is used. The circuit disclosed in FIG. 12 is the same as that described in U.S. Pat. No. 4,805,297, having a filter/-regulator 26 and a flow control check valve 21 in the "extend" line 19 of the cylinder, except that the cylinder 20 is double acting (not spring return), a "retract" line 23 is connected between the retract side of the cylinder 20 and the foot valve 24, and the foot valve 24 is a two position spring return four way valve connected so as to extend cylinder 20 upon actuation of the valve 24 and to retract cylinder 20 when valve 24 is released.

Many modifications and variations of the preferred embodiment will be apparent to those of ordinary skill in the art but will still be within the spirit and scope of the invention. For example, any type of slideway could be used as long as the table halves are slidable relative to the upper frame holder. Also, the upper frame holder could be modified to apply an outer frame half, with the inner frame half supported on the table. Therefore, the invention should not be limited by the scope of the preferred embodiments, but only by the claims which follow.

I claim:

1. An apparatus for applying frames to fabric, comprising:

a table for supporting a fabric article to which a frame is to be applied and for supporting a frame-half therefor beneath said fabric article;

a frame holder for holding an opposite frame-half above said table, said frame holder being movable toward said table so as to apply said opposite frame-half to said frame-half supported by the table with said fabric article between said frame halves; and a stand for supporting said table and said frame holder so as to be laterally slidable relative to one another so that the lateral position of said frame holder relative to said table can be adjusted;

wherein said table includes a pair of table halves and the lateral spacing between said table halves is adjustable;

wherein each said table half has a neck piece, each said neck piece being positioned at the front edge of its associated table half, extending forwardly therefrom and being mounted to its associated table half so as to be laterally adjustable in position relative thereto.

2. An apparatus as in claim 1, wherein each said neck piece is contoured so that when it is positioned adjacent to the other neck piece the two neck pieces define at their forward edges a shape approximating a neck and shoulder line of a garment.

3. An apparatus for applying frames to fabric, comprising:

a table for insertion into a sleeve-like body portion of a garment to which a frame is to be applied and for supporting a frame-half inside said garment, said table having a front, a rear and laterally spaced sides extending between said front and rear, said table being defined by two separate table halves; and a stand for supporting said table without obstruction on the front and sides thereof, said stand including a slideway for mounting said table halves at the rear of said table halves so that said table halves are laterally slidable relative to one another and relative to said stand so as to vary the lateral spacing between the sides of said table so that a garment can be slid over said table from the front thereof and the lateral spacing of said sides adjusted so as to conform said table to the size of said garment;

wherein each said table half has a neck piece, each said neck piece being positioned at the front edge of its associated table half, extending forwardly therefrom and being mounted to its associated table half so as to be laterally adjustable in position relative thereto.

* * * * *